US010992060B2

(12) United States Patent
Chen et al.

(10) Patent No.: US 10,992,060 B2
(45) Date of Patent: Apr. 27, 2021

(54) ANTENNA STRUCTURE AND WIRELESS COMMUNICATION DEVICE USING THE SAME

(71) Applicant: Shenzhen Chao-De Communication Co., Ltd, Shenzhen (CN)

(72) Inventors: Kuo-Cheng Chen, New Taipei (TW); Yi-Ming Chen, New Taipei (TW); Siang-Yu Siao, New Taipei (TW); Yi-Kuo Chen, New Taipei (TW); Hsi-Hsing Hsu, New Taipei (TW)

(73) Assignee: Shenzhen Next Generation Communications Limited, Shenzhen (CN)

( * ) Notice: Subject to any disclaimer, the term of this patent is extended or adjusted under 35 U.S.C. 154(b) by 49 days.

(21) Appl. No.: 16/419,638

(22) Filed: May 22, 2019

(65) Prior Publication Data

US 2019/0363456 A1 Nov. 28, 2019

Related U.S. Application Data

(60) Provisional application No. 62/674,634, filed on May 22, 2018.

(51) Int. Cl.

| | |
|---|---|
| ***H01Q 21/24*** | (2006.01) |
| ***H01Q 15/10*** | (2006.01) |
| ***H01Q 19/06*** | (2006.01) |
| ***H01Q 1/22*** | (2006.01) |
| ***H01Q 9/06*** | (2006.01) |
| ***H01Q 1/38*** | (2006.01) |
| ***H01Q 21/00*** | (2006.01) |
| ***H01Q 21/29*** | (2006.01) |

(52) U.S. Cl.

CPC ..... *H01Q 21/245* (2013.01); *H01Q 1/2258* (2013.01); *H01Q 1/2283* (2013.01); *H01Q 1/38* (2013.01); *H01Q 9/06* (2013.01); *H01Q 15/10* (2013.01); *H01Q 19/06* (2013.01); *H01Q 21/0006* (2013.01); *H01Q 21/0025* (2013.01); *H01Q 21/29* (2013.01)

(58) Field of Classification Search

None

See application file for complete search history.

(56) References Cited

U.S. PATENT DOCUMENTS 4,990,926 A * 2/1991 Otsuka ..... H01Q 1/125 343/700 MS
6,094,174 A * 7/2000 Knop ..... 343/781 P
(Continued)

FOREIGN PATENT DOCUMENTS

| | | | |
|---|---|---|---|
| CN | 1682402 | A | 10/2005 |
| CN | 104979637 | B | 3/2018 |
| CN | 107949955 | A | 4/2018 |

*Primary Examiner* — Crystal L Hammond
(74) *Attorney, Agent, or Firm* — ScienBiziP, P.C.

(57) ABSTRACT

A small-scale antenna structure with high gain and with controllable polarization direction includes a motherboard, an antenna array thereon, and antenna units. An array of lens units is superimposed directly over and covers the antenna units. A wireless communication device using the antenna structure is also provided. The wireless communication device includes a main body and the antenna structure. The main body receives the antenna structure.

14 Claims, 7 Drawing Sheets

(56) References Cited

U.S. PATENT DOCUMENTS

| | | | | |
|---|---|---|---|---|
| 6,985,132 | B2 * | 1/2006 | Nomura | G09F 9/372 345/107 |
| 8,213,757 | B2 * | 7/2012 | Harrysson | H01Q 1/38 385/120 |
| 9,419,249 | B2 * | 8/2016 | Yamaguchi | G02F 1/133502 |
| 2004/0108963 | A1 | 6/2004 | Clymer et al. | |
| 2006/0139215 | A1 | 6/2006 | Heiniger | |
| 2010/0260460 | A1 * | 10/2010 | Harrysson | H01Q 1/243 385/119 |
| 2011/0215976 | A1 | 9/2011 | Clymer et al. | |
| 2012/0019423 | A1 * | 1/2012 | Schultheiss | H01Q 21/065 343/753 |
| 2015/0357718 | A1 | 12/2015 | Singh | |
| 2017/0062944 | A1 | 3/2017 | Zimmerman et al. | |
| 2019/0089052 | A1 * | 3/2019 | Yong | H01Q 1/2283 |

* cited by examiner

ANTENNA STRUCTURE AND WIRELESS COMMUNICATION DEVICE USING THE SAME

FIELD

The subject matter herein generally relates to wireless communications.

BACKGROUND

Since a millimeter wave microstrip antenna has a short operating wavelength and a large dielectric loss, making the antenna to be a high gain antenna and also capable of radiating electromagnetic waves in multiple polarizations is problematic.

Therefore, there is room for improvement within the art.

BRIEF DESCRIPTION OF THE DRAWINGS

Implementations of the present technology will now be described, by way of example only, with reference to the attached figures.

DETAILED DESCRIPTION

Figure 1:
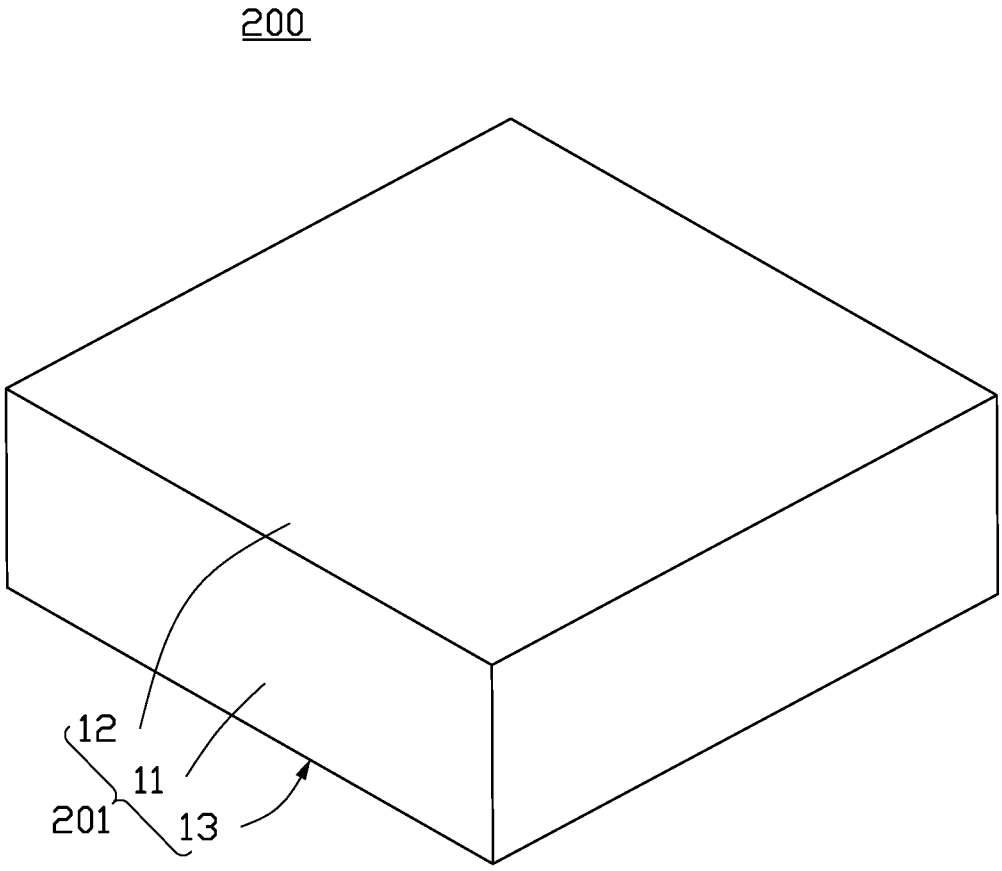
FIG. 1 is an isometric view of an embodiment of a wireless communication device using an antenna structure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure. It should be noted that references to "an" or "one" embodiment in this disclosure are not necessarily to the same embodiment, and such references mean "at least one."

Several definitions that apply throughout this disclosure will now be presented.

The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series, and the like.

The term "coupled" is defined as connected, whether directly or indirectly through intervening components, and is not necessarily limited to physical connections. The connection can be such that the objects are permanently connected or releasably connected.

FIG. 1 shows an embodiment of an antenna structure 100. The antenna structure 100 can be applied to a wireless communication device 200. The antenna structure 100 is configured to transmit and to receive wireless signals. The wireless communication device 200 can be, for example, a mobile phone, a personal digital assistant, or an MP3 player. The wireless communication device 200 includes a main body 201. The wireless communication device 200 can further include, but is not limited to, other mechanical structures, electronic components, modules, and software.

The main body 201 includes a first side wall 11, an upper surface 12, and a lower surface 13 opposite to the upper surface 12. The first side wall 11 connects with the upper surface 12 and the lower surface 13. The first side wall 11, the upper surface 12, and the lower surface 13 can be seen as forming a receiving space (not shown). The receiving space is configured for receiving the antenna structure 100.

The antenna structure 100 includes a motherboard 10, an antenna array 30, and a lens array 40.

The motherboard 10 can be a printed circuit board (PCB). The motherboard 10 can be made of dielectric material, for example, epoxy resin glass fiber (FR4), or the like. The motherboard 10 is positioned in the main body 201 adjacent to the upper surface 12 or the lower surface 13.

The motherboard 10 includes a second side wall 21, a first surface 22, and a second surface 23 opposite to the first surface 22. The second side wall 21 can electrically connected to the first surface 22 and the second surface 23. In this embodiment, the second side wall 21 is substantially perpendicularly connected between the first surface 22 and the second surface 23.

The antenna array 30 is positioned on the first surface 22 or the second surface 23 of the motherboard 10. For example, in this embodiment, the antenna array 30 can be positioned on the first surface 22 of the motherboard 10. In other embodiments, the antenna array 30 can be positioned on the second side wall 21 of the motherboard 10. The antenna array 30 can be made of metal material, for example, the antenna array 30 can be made of a copper foil.

In this embodiment, the antenna array 30 includes N*M antenna units 31. N and M are positive integers greater than 1. The N rows of the antenna units 31 are arranged in a first direction, for example, an X-axis direction. The M rows of the antenna units 31 are arranged in a second direction, for example, a Y-axis direction. Each antenna unit 31 is positioned on an X-Y plane. The antenna array 30 is an array of half wavelength antennas. Shape and size of each of the N*M antenna units 31 are the same. Each antenna unit 31 is circular, and a diameter of each antenna unit 31 is a half wavelength.

A gap distance between each antenna unit 31 is also a half wavelength. That is, the gap distance between center point of each of the antenna units 31 is one wavelength. The one "Wavelength" is the wavelength of a radio wave transmitted or received by the antenna structure 100, such wavelengths are fixed and stable in frequency and magnitude.

Figure 3:
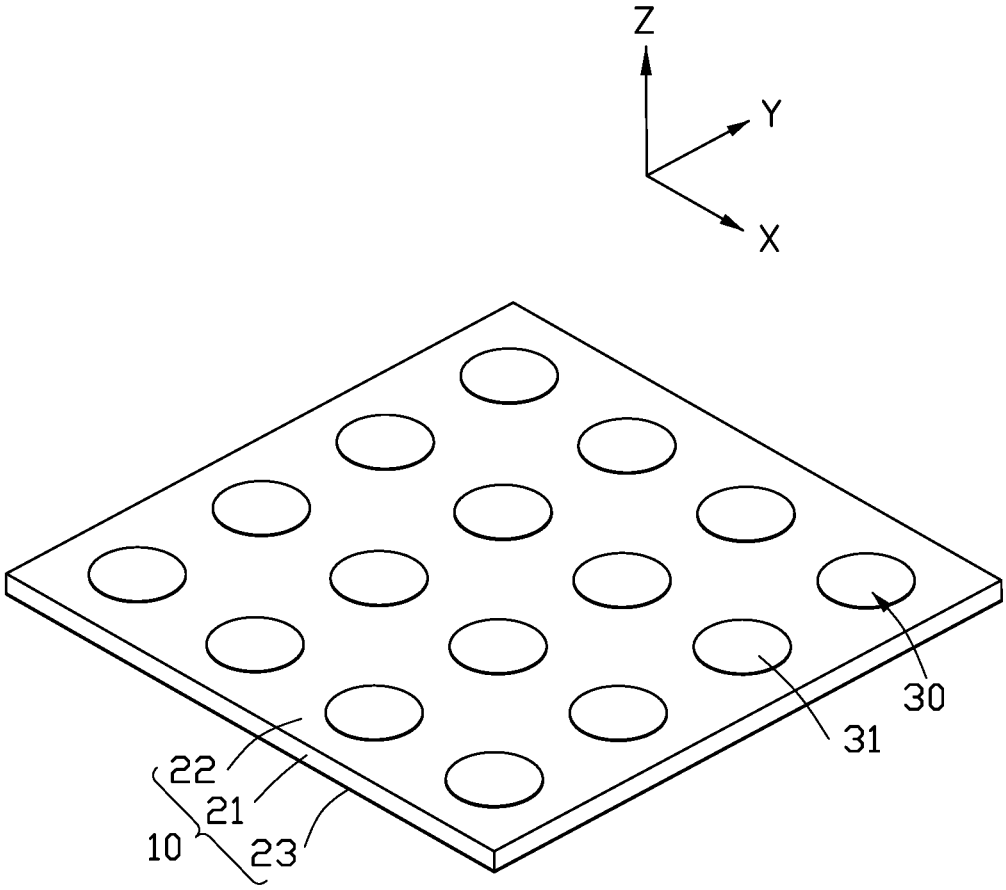
FIG. 3 shows part of the antenna structure of FIG. 2.

In this embodiment, referring to FIG. 3, the N is 4, and the M is 4. The antenna array 30 includes 4*4 antenna units 31.

Figure 4:
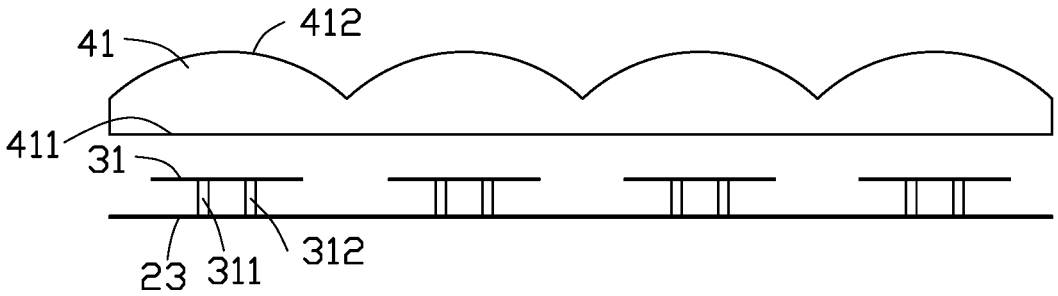
FIG. 4 is similar to FIG. 2, but shown from another angle.

Referring to FIG. 4, each antenna unit 31 includes a first feeding portion 311 and a second feeding portion 312. The first feeding portion 311 and the second feeding portion 312 are both metal columns. One end of the first feeding portion 311 is electrically connected to the antenna units 31. Another end of the first feeding portion 311 is electrically connected to a first feeding source (not shown) of the motherboard 10.

One end of the second feeding portion 312 is electrically connected to the antenna unit 31. Another end of the second feeding portion 312 is electrically connected to a second feeding source (not shown) of the motherboard 10. The first feeding portion 311 and the second feeding portion 312 are both positioned on the first surface 22. The first feeding source and the second feeding source are positioned on the second surface 23. In other embodiments, the first feeding portion 311 and the second feeding portion 312 can be positioned on the first surface 22 and/or the second surface 23. The first feeding portion 311 and the second feeding portion 312 feed current and signals to each antenna unit 31.

When each first feeding portion 311 supplies current and signals, the current flows through each antenna unit 31 and activates each antenna unit 31 to radiate in a first polarization. When current and signals flow from each second feeding portion 312, the current flows to each antenna unit 31 and activates each antenna unit 31 to radiate in a second polarization. In this embodiment, the first polarization is a horizontal polarization. The second polarization is a vertical polarization. The horizontal polarization can be an X-Y plane polarization, and the vertical polarization can be a Z-direction polarization. In other embodiments, the first polarization direction and the second polarization direction can be other orientations.

In this embodiment, the lens array 40 includes N*M lens units 41. The N and M are positive integers greater than 1. The N rows of the lens units 41 are arranged in the first direction, for example, the X-axis direction. The M rows of the lens units 41 are arranged in the second direction, for example, the Y-axis direction. The lens array 40 is spaced apart from and parallel to the antenna array 30. Shape and size of each of the N*M lens units 41 are the same. Shape of each lens unit 41 is a circular, and a diameter of each lens unit 41 is one wavelength. No gap distance exists between each lens unit 41. That is, the gap distance between each center point of the lens units 41 is one wavelength.

In this embodiment, the whole lens array 40 can be made of high dielectric constant material, for example, ceramic or glass. The lens array 40 is integrally formed.

In this embodiment, each lens unit 41 is positioned above each antenna unit 31. That is, a center point of each lens unit 41 is positioned directly above the center point of each antenna unit 31. That is, each lens unit 41 is concentric to and covers an antenna unit 31. Each lens unit 41 increases a gain of an antenna unit 31 and concentrates a radiation orientation or a polarity of the antenna unit 31. Radiation of the antenna structure 100 is concentrated in a signal transmission direction.

Figure 2:
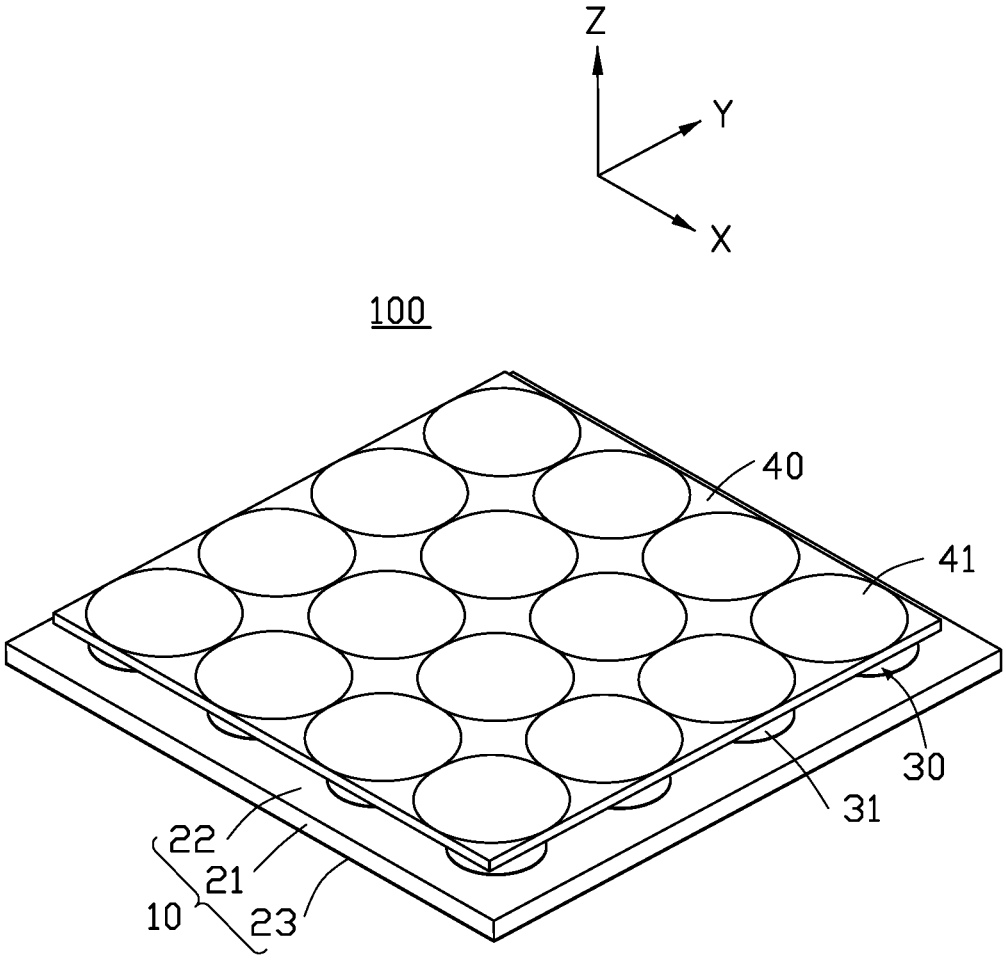
FIG. 2 is an isometric view of an embodiment of the antenna structure of FIG. 1 from one angle.

In this embodiment, referring to FIG. 2, the N is 4, and the M is 4, the lens array 40 includes 4*4 lens units 41.

In this embodiment, referring to FIG. 4, each lens unit 41 is convex shaped. Each lens unit 41 includes a first surface 411 and a second surface 412. The first surface 411 is near the antenna array 30, the first surface 411 is flat. The second surface 412 is far away from the antenna array 30. The second surface 412 is convex.

Figure 5:
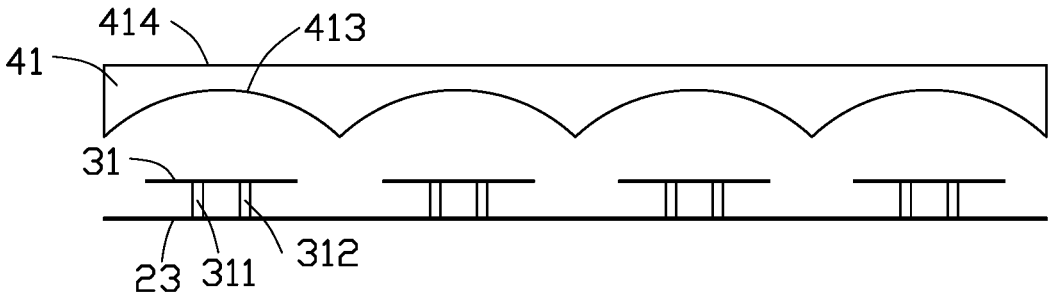
FIG. 5 is an isometric view of another embodiment of the antenna structure of FIG. 4.

In another embodiment, referring to FIG. 5, each lens unit 41 is concave shaped. Each lens unit 41 includes a third surface 413 and a fourth surface 414. The third surface 413 is near the antenna array 30. The third surface 413 is concave. The fourth surface 414 is far away from the antenna array 30. The fourth surface 414 is flat.

Figure 6:
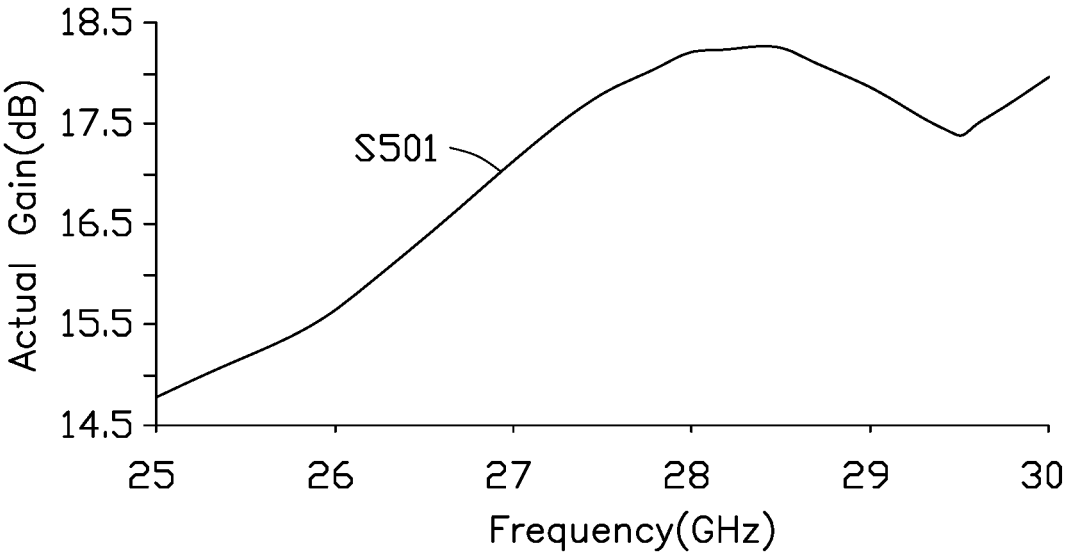
FIG. 6 is an actual gain graph of the antenna structure of FIG. 2.

FIG. 6 is a graph of actual gain of the antenna structure 100. The curve S501 is an actual gain of the antenna structure 100.

Figure 7:
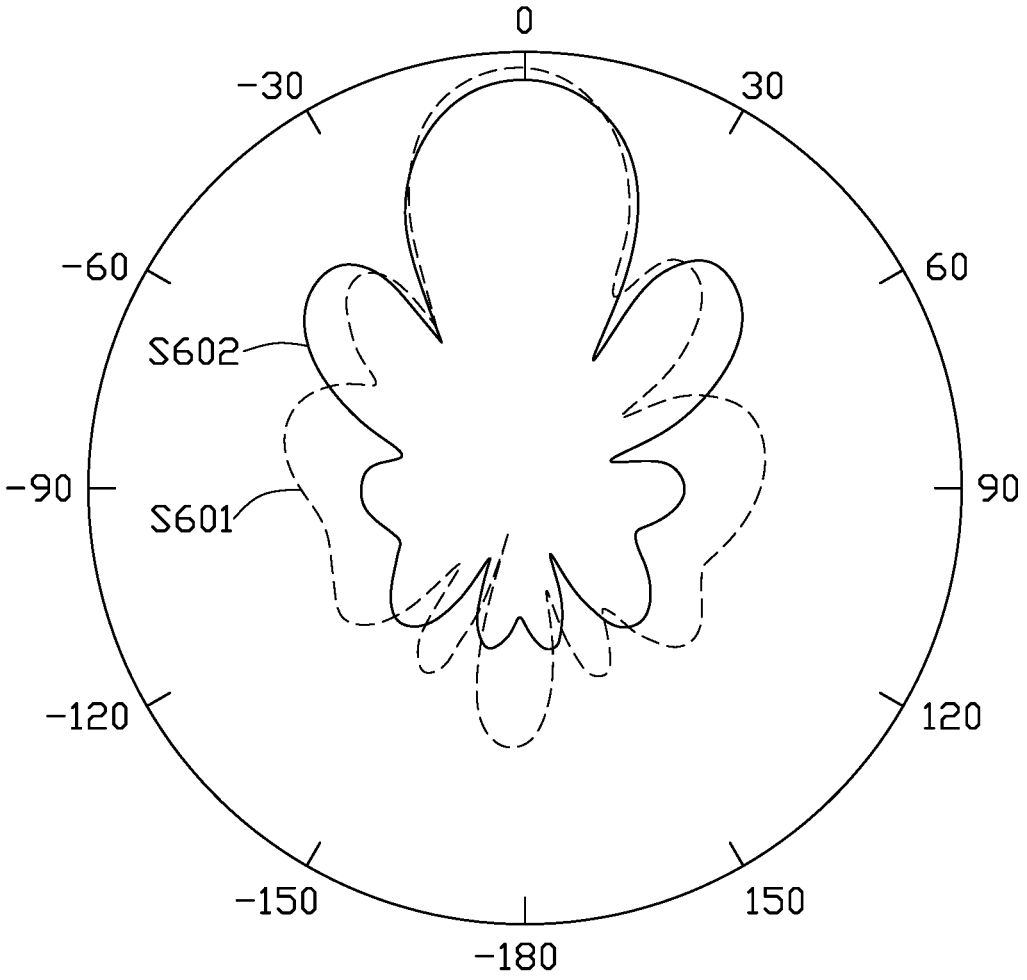
FIG. 7 is a radiation pattern graph of the antenna structure of FIG. 2.

FIG. 7 is a radiation pattern graph of the antenna structure 100. The curve S601 is a radiation pattern of the antenna structure 100 when the lens array 40 is positioned above the antenna array 30 and a radiation frequency of the antenna structure 100 is 28 GHz. The curve S602 is a radiation pattern of the antenna structure 100 when the lens array 40 is not positioned above the antenna array 30 and the frequency is the same. Curves S601 and S602 show that when the antenna structure 100 includes the lens array 40, a total gain of the antenna structure 100 is significantly improved.

The antenna structure 100 includes a lens array 40 positioned above the antenna array 30, which can increase the gain of the antenna structure 100 and concentrate the radiation orientation or a polarity of the antenna structure 100.

The embodiments shown and described above are only examples. Many details are often found in the art such as the other features of the antenna structure and the wireless communication device. Therefore, many such details are neither shown nor described. Even though numerous characteristics and advantages of the present technology have been set forth in the foregoing description, together with details of the structure and function of the present disclosure, the disclosure is illustrative only, and changes may be made in the details, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. An antenna structure, comprising:

a motherboard;

an antenna array positioned on a surface of the motherboard and comprising a plurality of antenna units; and a lens array comprising a plurality of lens units;

wherein each lens unit of the plurality of lens units is positioned above each antenna unit of the plurality of antenna units;

wherein a shape and a size of each antenna unit of the plurality of antenna units are the same, and the shape of each antenna unit is circular, and a shape and a size of each lens unit are the same, and the shape of each lens unit is circular; a diameter of each antenna unit along a direction parallel with the surface of the motherboard is one half of a wavelength, a diameter of each lens unit along a direction parallel with the surface of the motherboard is one wavelength, the one wavelength is the wavelength of a radio wave transmitted or received by the antenna structure; each antenna unit comprises a first feeding portion and a second feeding portion, the first and second feeding portions are configured to feed current to excite each antenna unit to radiate waves in vertical and horizontal polarizations.

2. The antenna structure of claim 1, wherein each lens units is positioned above an antenna unit and concentric to the corresponding antenna unit, and each lens unit covers the antenna unit.

3. The antenna structure of claim 1, wherein the lens array is made of high dielectric constant material, and the lens array increases a gain of the antenna array and concentrates a radiation orientation or a polarity of the antenna array.

4. The antenna structure of claim 2, wherein the lens array is made of ceramic or glass.

5. The antenna structure of claim 1, wherein each lens unit is convex shaped, and each lens unit comprises a first surface and a second surface, the first surface is near the antenna array, the first surface is flat, and the second surface is far away from the antenna array, the second surface is convex.

6. The antenna structure of claim 1, wherein each lens unit is concave shaped, and each lens unit comprises a third surface and a fourth surface, the third surface is near the antenna array, the third surface is concave, and the fourth surface is far away from the antenna array, the fourth surface is flat.

7. The antenna structure of claim 1, wherein a gap distance between each antenna unit is a half wavelength.

8. A wireless communication device comprising a main body, and an antenna structure is received in the main body, wherein the antenna structure comprises:

a motherboard;

an antenna array positioned on a surface of the motherboard and comprising a plurality of antenna units; and a lens array comprising a plurality of lens units;

wherein each lens units of the plurality of lens units is positioned above each antenna unit of the plurality of antenna units;

wherein a shape and a size of each antenna unit of the plurality of antenna units are the same, and the shape of each antenna unit is circular, and a shape and a size of each lens unit are the same, and the shape of each lens unit is circular; a diameter of each antenna unit along a direction parallel with the surface of the motherboard is one half of a wavelength, a diameter of each lens unit along a direction parallel with the surface of the motherboard is one wavelength, the one wavelength is the wavelength of a radio wave transmitted or received by the antenna structure; each antenna unit comprises a first feeding portion and a second feeding portion, the first and second feeding portions are configured to feed current to excite each antenna unit to radiate waves in vertical and horizontal polarizations.

9. The wireless communication device of claim 8, wherein each lens units is positioned above an antenna unit and concentric to the corresponding antenna unit, and each lens unit covers the antenna unit.

10. The wireless communication device of claim 9, wherein the lens array is made of ceramic or glass.

11. The wireless communication device of claim 8, wherein the lens array is made of high dielectric constant material, and the lens array increases a gain of the antenna array and concentrates a radiation orientation or a polarity of the antenna array.

12. The wireless communication device of claim 8, wherein each lens unit is convex shaped, and each lens unit comprises a first surface and a second surface, the first surface is near the antenna array, the first surface is flat, and the second surface is far away from the antenna array, the second surface is convex.

13. The wireless communication device of claim 8, wherein each lens unit is concave shaped, and each lens unit comprises a third surface and a fourth surface, the third surface is near the antenna array, the third surface is concave, and the fourth surface is far away from the antenna array, the fourth surface is flat.

14. The wireless communication device of claim 8, wherein a gap distance between each antenna unit is a half wavelength.

* * * * *